United States Patent [19]

Bailey et al.

[11] Patent Number: 5,038,807

[45] Date of Patent: Aug. 13, 1991

[54] PERFORMANCE MONITORING SYSTEM FOR WAREWASHING MACHINES

[75] Inventors: Clyde A. Bailey, Hastings; Eric L. Padelford, Lakeland; Daniel F. Brady, Eagan, all of Minn.; Eduardo S. Koehler, Rio de Janeiro, Brazil

[73] Assignee: Ecolab, Inc., St. Paul, Minn.

[21] Appl. No.: 509,992

[22] Filed: Apr. 16, 1990

[51] Int. Cl.[5] ..... B08B 3/02

[52] U.S. Cl. ..... 134/57 D; 134/580; 134/131

[58] Field of Search ..... 134/56 R, 56 D, 57 D, 134/58 D, 57 R, 58 L, 131; 68/12 R; 340/309.2; 364/267.6, 550.01

[56] References Cited

U.S. PATENT DOCUMENTS

| | | | |
|---|---|---|---|
| 3,774,056 | 11/1973 | Sample et al. | 134/57 D |
| 4,241,400 | 12/1980 | Kiefer | 134/57 D X |
| 4,509,543 | 4/1985 | Livingston et al. . | |
| 4,756,321 | 7/1988 | Livingston et al. . | |

FOREIGN PATENT DOCUMENTS

| | | | |
|---|---|---|---|
| 68267 | 1/1983 | European Pat. Off. | 134/58 D |
| 3314992 | 10/1984 | Fed. Rep. of Germany | 134/56 D |
| 3400495 | 7/1985 | Fed. Rep. of Germany | 134/57 D |
| 61-21118 | 5/1986 | Japan | 68/12 R |
| 63-077493 | 4/1988 | Japan | 68/12 R |
| 673680 | 7/1979 | U.S.S.R. | 68/12 R |

OTHER PUBLICATIONS

"Wexiodisk AB".
"Introducing . . . Mentor from Diversey Wyandotte".
"DiverlogD The Dishroom Intelligence System".

*Primary Examiner*—Frankie L. Stinson
*Attorney, Agent, or Firm*—Merchant, Gould, Smith, Edell, Welter & Schmidt

[57] ABSTRACT

A system for monitoring the performance of a warewashing machine generates proactive alarms that audible and/or visibly instruct operators to take corrective action of temperature, rinse pressure, loading, or other machine deficiencies occur. A data input feature enables the operator to add production data to the report for the calculation of machine efficiency. A water consumption measurement device provides realistic utility, water and sewage costs calculations for the warewashing machine.

15 Claims, 3 Drawing Sheets

PERFORMANCE MONITORING SYSTEM FOR WAREWASHING MACHINES

BACKGROUND OF THE INVENTION

1. Field of the Invention.

This invention relates generally to an improved warewashing machine. In particular, it is directed to a performance monitoring system for warewashing machines 2. Description of Related Art It is known in the art to provide warewashing machine analysis systems. Typically, such systems monitor and/or report on such operating parameters as operating time, detergent level, feed time of detergent dispensers, sanitizer level, drying agent level, wash temperature, rinse additive consumption, final rinse temperature, final rinse time, frequency of drains, dirty wash water, and dirty rinse jets.

Using a link to a personal computer and printer, the system may produce reports that organize the above-described information and describe how efficiently and effectively the warewashing machine has been operating during prior periods. Usually, each day of production is broken down into morning, noon, evening, and/or night shifts.

The major perceived benefits of these systems are that they provide a management tool and monitor that reports on operational deficiencies. The reporting functions provide a shift-by-shift breakdown of manpower and equipment efficiency, thus filling a void for reliable information on warewashing.

However, these systems do have some major shortcomings. While some functions are monitored, no proactive alarms or control devices enable the operators to correct problems as they occur. Typically, machine efficiency is determined using a unit of measure termed "racks", which does not accurately reflect how large rackless conveyor machines process their wares. In addition, customers cannot compare actual production as measured by the number of meals produced with the operational information gathered by the system, hence, there is no standard of performance to compare the operational information to. Also, water consumption, which is one of the most accurate indications of total warewashing costs, is not measured.

SUMMARY OF THE INVENTION

To overcome the limitations in the art described above, and to overcome other limitations that will become readily apparent upon reading this specification, the present invention provides a system which monitors the status of warewashing machines, provides proactive alarms, records performance data, and reports on the critical control points of warewashing machines. Thus, the present invention insures that the warewashing machine is operated at optimum efficiency.

BRIEF DESCRIPTION OF THE DRAWINGS

Referring now to the drawings, in which like reference numbers represent corresponding elements throughout.

DETAILED DESCRIPTION OF THE PREFERRED EMBODIMENT

In the following description of the preferred embodiment, reference is made to the accompanying drawings which form a part hereof, and in which is shown by way of illustration a specific embodiment in which the invention may be practiced. It is to be understood that other embodiments may be used and structural changes may be made without departing from the scope of the present invention.

Figure 1:
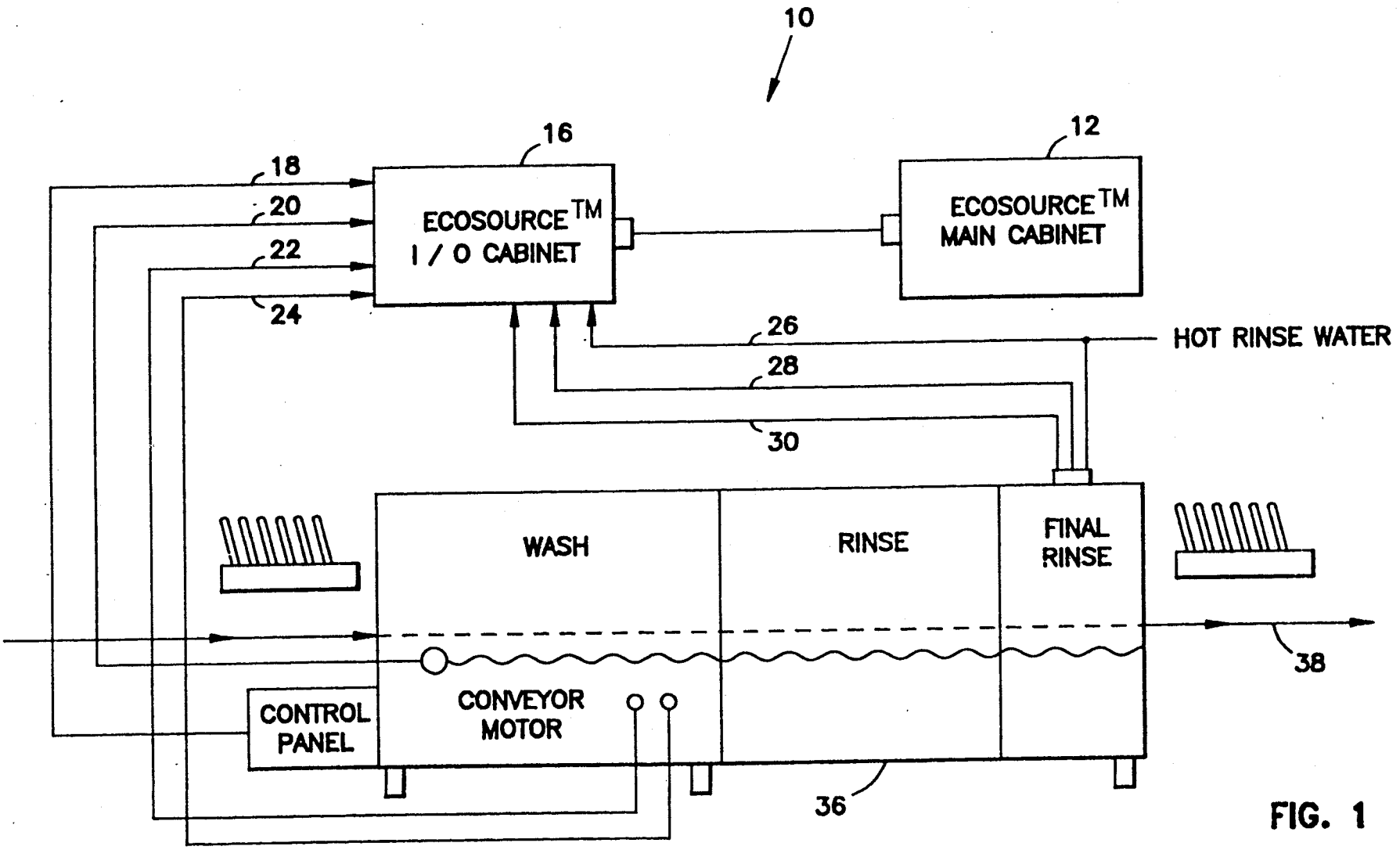
FIG. 1 is a block diagram showing the interconnection between the warewashing machine and the monitoring system.
Figure 2:
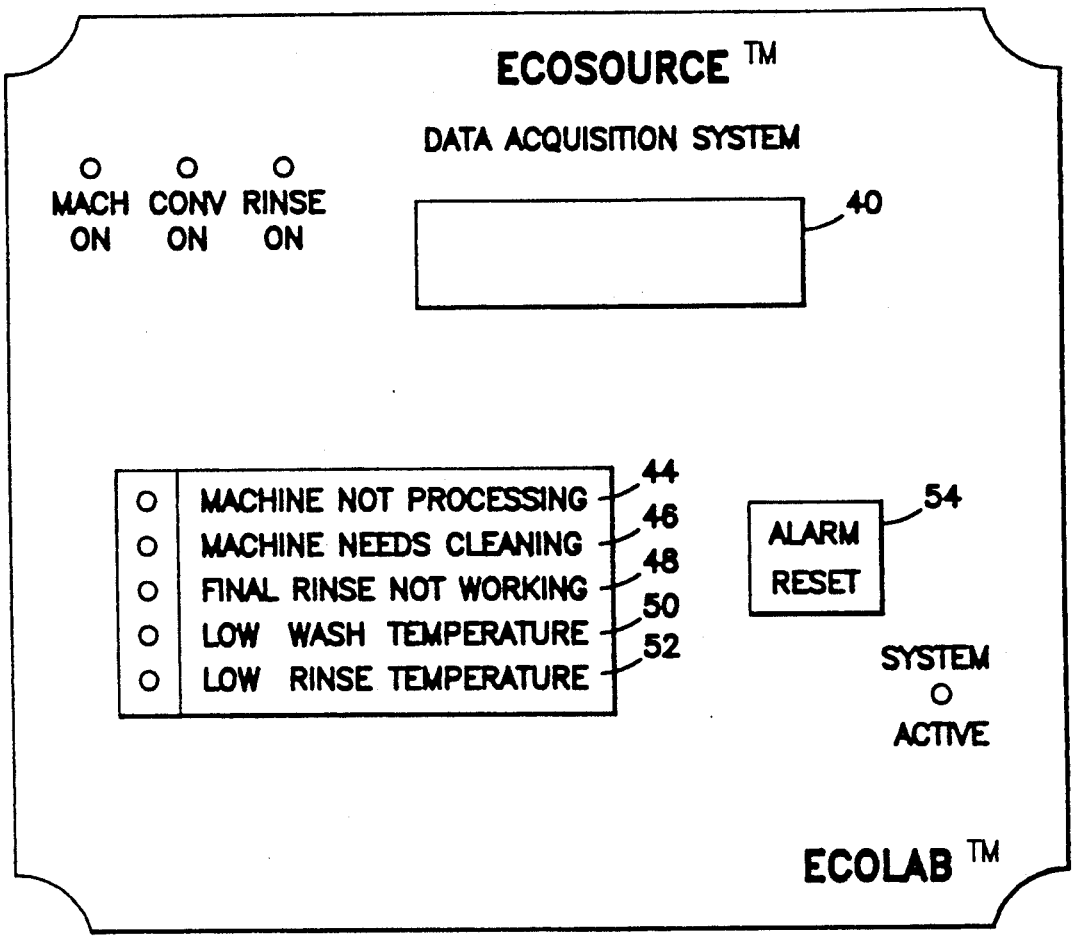
FIG. 2 is a diagram of the operator panel for the monitoring system.
Figure 3:
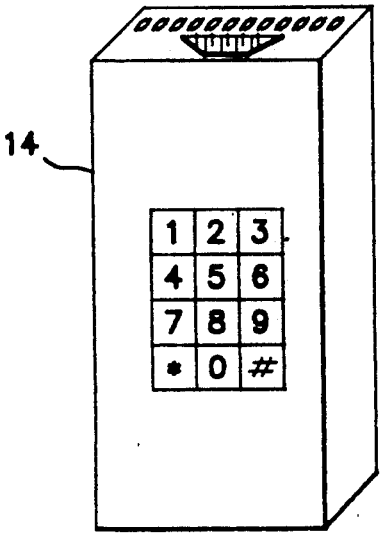
FIG. 3 is a diagram illustrating a hand-held communicator.

The preferred embodiment of the present invention provides a system to monitor, quantify, and control overall warewashing efficiency. Proactive monitoring and alarms support day-to-day operations. Recording and reporting functions support analysis of machine performance, efficiency, and support capacity planning functions. The system is designed to monitor and report on the critical control points of a conventional dishwashing machine with conveyer. Those skilled in the art will recognize that the present invention could be used with any type of warewashing machine FIG. 1 discloses a preferred embodiment of the present invention. The preferred embodiment is a system 10 that includes a microprocessor 12, a display (shown in FIG. 2), a hand-held communicator 14 (shown in FIG. 3) connected to the microprocessor 12 via a data entry interface, a printer (not shown) connected to the microprocessor via a printer interface, an I/O interface 16, and a plurality of sensors 18, 20, 22, 24, 26, 28, and 30 that are installed on the warewashing machine 36 and connected to the microprocessor 12 via the I/O interface 16. Those skilled in the art will recognize that the present invention could be used with different components or combinations of components than those described above.

The preferred embodiment receives inputs from three existing control circuits including the wash motor sensor 18, conveyor motor sensor 20, and final rinse solenoid valve sensor 26. Machine run-time and conveyor run-time are determined from the signals received by the microprocessor 12 via the I/O interface 16 from the wash motor sensor 18 and conveyer motor sensor 20. Rinse run-time is determined from the signal received by the microprocessor 12 via the I/O interface 16 from the final rinse solenoid valve sensor 26.

Additional sensors are installed on the warewashing machine 36, including a temperature sensor 22 for the wash tank, an empty tank sensor 24 for the wash tank, a final rinse pressure sensor 28, and a temperature sensor 30 for the final rinse.

The wash temperature sensor 22 is a thermosensor installed in the wash tank. A typical thermostat in the I/O interface 16 connects to the sensor 22 and allows the operator to specify the temperature below which the alarm condition occurs. When the thermostat in the I/O interface 16 detects an alarm condition, a corresponding signal is sent to the microprocessor 12.

The frequency of drain operations is determined by a sensor 24 installed in the wash tank. The sensor 24 is preferably a limit switch mounted towards the bottom of the wash tank so that if the water level falls below the switch, it indicates that the tank is drained. The sensor 24 must be low enough to trigger only when the wash tank is drained. If the tank is not drained after a period of time has elapsed, then the alarm condition occurs. When the I/O interface 16 detects an alarm condition, a corresponding signal is sent to the microprocessor 12.

Deficiencies in final rinse flow pressure are determined by a pressure measuring sensor 28 installed in the final rinse. Such sensors are well known in the art and can be purchased preset to a particular PSI (pounds per square inch) value. If the pressure falls below the preset PSI value, the alarm condition occurs. When the I/O interface 16 detects an alarm condition, a corresponding signal is sent to the microprocessor 12.

The final rinse temperature sensor 30 is a thermosensor installed in the final rinse. A typical thermostat in the I/O interface connects to the sensor 30 and allows the operator to specify the temperature below which the alarm condition occurs. When the thermostat in the I/O interface 16 detects an alarm condition, a corresponding signal is sent to the microprocessor 12.

Water consumption is calculated by multiplying a known flow rate by an elapsed period. The elapsed period is determined by rinse run-time, which is determined from the final rinse solenoid valve sensor 26 as described above.

Those skilled in the art will recognize that other types of sensors, and different combinations thereof, could be substituted for the sensors used in the preferred embodiment.

The sensors, and the machine-generated inputs derived therefrom, enable the preferred embodiment to generate alarms for operational deficiencies, and to timestamp and record an overall operational history of the machine 36 for some period of time. Preferably, the operational history is recorded for a period of up to thirty days of operation, although any length period could be substituted therefor if the appropriate memory requirements were satisfied.

The system 10 has a plurality of user selectable inputs accessible via the communicator 14. These inputs are accessed by pushing the "*" function key on the communicator 14 to invoke software executing on the microprocessor 12.

The software includes a number of functional modules. A time management module provides day-by-day and shift tracking of warewashing operations. A database management module collects, organizes and reports on the above functions. A data entry module permits input of the number of "meals produced" and/or "covers washed" and/or "man hours of the labor" to be incorporated with reporting functions.

Using the data entry module, alarm timers and other information may be programmed into the software executing on the microprocessor 12. To program the alarm timers, and other information, the user presses the "*" function key on the communicator 14 to invoke the software executing on the microprocessor 12. The user observes the display 40 shown in FIG. 2, and changes existing values by entering new data which then appears on the display 40. This interaction occurs in a language that was pre-selected during account setup. Once the new data has been entered, the operator simply presses the "#" key and the new variable is set in the software. To proceed to the next option, the operator simply presses the "*" key once again.

The operator has a number of variables that he may preset in the system 10. The DATE variable allows the operator to set the current date. The TIME variable allows the operator to set the current time. The MORNING PERIOD variable allows the operator to set the normal morning operating period for the machine 36; the AFTERNOON PERIOD variable allows the operator to set the normal mid-day operating period; the EVENING PERIOD variable allows the operator to set the normal evening operating period. The TIMER ALARM 1 variable allows the operator to set the delay time for alarm 1, which is the number of minutes the machine 36 operates without the final rinse operating. The TIMER ALARM 2 variable allows the operator to set the delay time for alarm 2, which is the number of hours of total machine operation without the tanks being drained and cleaned. The TIMER ALARM 3 variable allows the operator to set the delay time for alarm 3, which is the number of seconds after the final rinse solenoid is activated before an acceptable rinse pressure is achieved. The TIMER ALARM 4 allows the operator to set the delay time for alarm 4, which is the reactivation time after the alarm indicating the low wash temperature has been reset. The TIMER ALARM 5 variable allows the operator to set the delay time for alarm 5, which is the low rinse temperature. The WATER CONSUMPTION variable allows the operator to set the volume of water that the machine 36 consumes per hour of final rinse operation (typically the machine specification will include this information). The MEALS PROCESSED IN PERIOD variable allows the operator to set the production numbers at the end of a reporting period. The system 10 will compare operating and processing hours to customer production and calculate "meals processed per hour" and report the same to the operator.

In the preferred embodiment, if the machine 36 is operating and an alarm condition occurs, an appropriate LED 44, 46, 48, 50, or 52 will flash, an audible signal will sound, and the alarm occurrence is recorded in memory along with the time and date of the occurrence. To turn off the audible signal, the operator presses the reset button 54, whereupon the LED 44, 46, 48, 50, or 52 stops flashing and only glows. The LED 44, 46, 48, 50, or 52 is turned off once the alarm condition is corrected.

Figure 4:
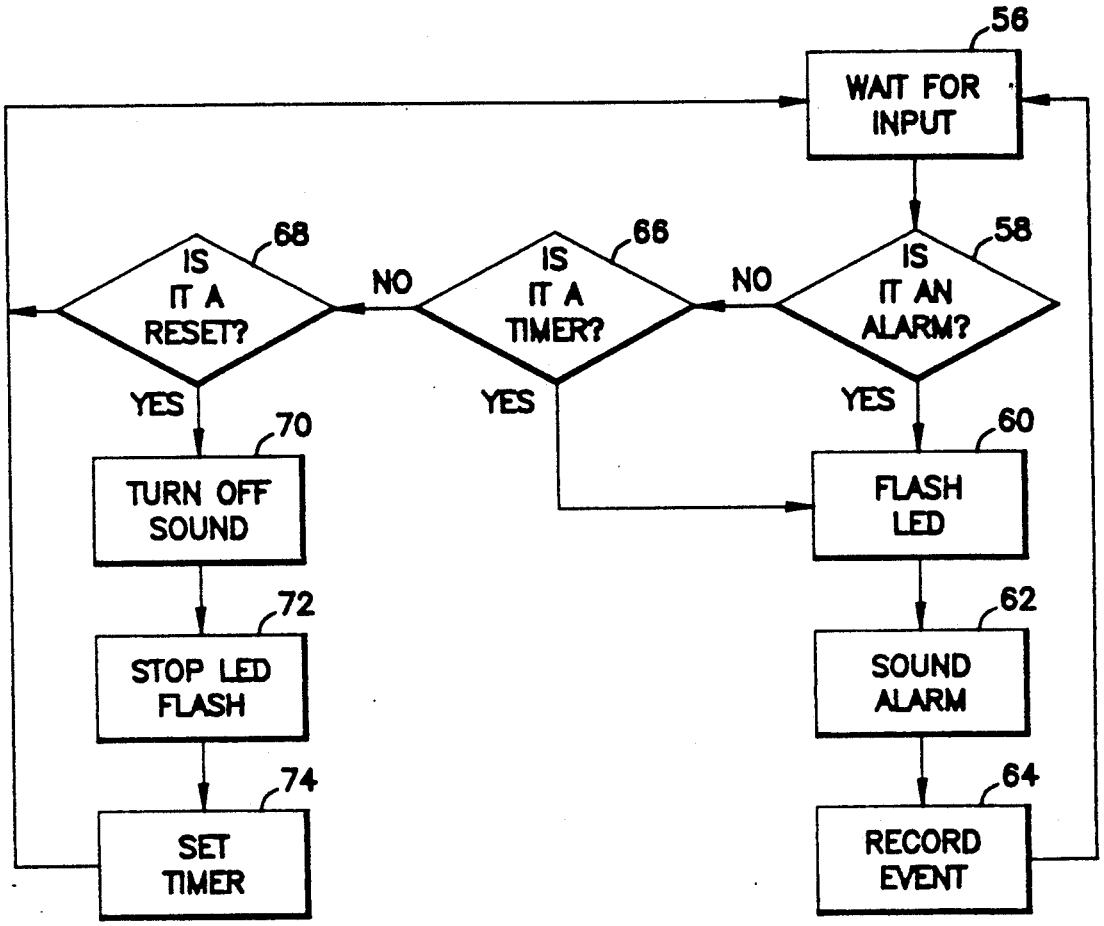
FIG. 4 is a flow chart diagram describing the steps for an alarm condition.

FIG. 4 is a flow chart describing the steps performed by the system 10 when an alarm condition occurs. The system 10 waits for an input (56). If the input is an alarm signal (58), then the appropriate LED is flashed (60), the audible signal is sounded (62), and the event is recorded (64). If the input is not an alarm (58) but it is a timer (66), i.e., TIMER ALARM 1, TIMER ALARM 2, TIMER ALARM 3, TIMER ALARM 4, or TIMER ALARM 5, then the appropriate LED is flashed (60), the audible signal is sounded (62), and the event is recorded (64). If the input is not a timer (66) but it is a reset (68), then the audible signal is turned off (70), the LED stops flashing and just glows (72), and the timer is set (74). Those skilled in the art will recognize that other types of input would be handled differently.

The following example further illustrates the operation of the system 10. If the wash temperature falls below a minimum set point, the "low wash temperature" alarm LED 50 flashes and the audible alarm is activated. If the reset button 54 is pressed, the audible alarm is deactivated and the LED 50 stops flashing. Once the low temperature condition is corrected, the LED 50 is turned off. However, if the low temperature condition is not corrected and the TIMER ALARM 4 period elapses, the LED 50 will once again flash and the audible alarm will once again sound. Each of the alarms work in a similar fashion. Further, every timer occurrence is recorded in memory along with the date and time of occurrence.

The system 10 uses the memory as a data storage for later use in reporting the events previously described. The hand-held communicator 14 is used to request reports. A printer 34 is supplied for printing the reports.

A number of reports are available with the system 10, including a summary report, a machine on-time report, and an alarm report. The summary report is an aggregation of the other reports. The machine on-time report prints the details regarding when the machine 36 was active. The alarm detail report allows the operator to obtain a report on the number of times specific alarms occurred during a period. Further information is provided by a water consumption report.

In order to understand the need for the reports, it is best to describe how the various factors reflect on the overall operating efficiency of the warewashing operation. Temperatures are reported because the relationship between temperatures, results, and sanitation are very important. Machine efficiency is measured by comparing the functions of the machine 36 to total operating hours.

For example, a rackless conveyor 38 normally has three operating systems related to washing dishes: the pumps, the conveyor 38, and the fresh water final rinse. Each of these systems operate independently from the others. Therefore an efficient operation only operates the machine 36 when dishes are being loaded on the belt and the belt is fully loaded. An inefficient operation runs the machine 36 whether dishes are being processed or not, and only partially loads the conveyor 38.

The reports produced by the preferred embodiment provide total operating hours, conveyor operating hours, and rinse operating hours. The preferred embodiment also calculates "loading efficiency" by comparing total final rinse hours to total operating hours. The system 10 also calculates "conveyor efficiency" by comparing total operating hours to conveyor operating hours. On the other hand, if the system 10 only used a "rack equivalent" measurement to calculate machine 36 efficiency, the system 10 would miss the most meaningful measurement of machine 36 efficiency.

The operator may request a report wherein the system 10 calculates the average number of meals processed per hour machine 36 operation. This is done simply by entering the production number for the period covered into the MEALS PROCESSED IN PERIOD variable and then printing the report. The system 10 divides the MEALS PROCESSED IN PERIOD value by the total hours of operation. The result is stated as "operating efficiency". The system 10 also calculates the "processing efficiency" by dividing the MEALS PROCESSED IN PERIOD value by the total hours that the machine 36 was actually processing dishes. This is determined by the number of hours the final rinse was in operation for those machines 36 equipped with final rinse systems activated by a limit switch that engages when dishes or racks contact the switch. If the machine 36 has a constant final rinse operation, the number is the same for both "operating efficiency" and "processing efficiency".

In summary, the present invention is a system which provides proactive alarms that audible and/or visibly instruct operators to take corrective action if temperature, rinse pressure, or other machine events occur. The system has a data input feature that permits the operator to input the number of "meals produced" and/or "cover washed" and/or "man hours of labor" for subsequent calculation and reports. Finally, the system provides a water consumption measurement device to provide realistic utility, water and sewage costs calculations.

The foregoing description of the preferred embodiment of the invention has been presented for the purposes of the illustration and description. It is not intended to be exhaustive or to limit the invention to the price precise form disclosed. Many modifications are variations are possible in light of the above teaching. It is intended that the scope of the invention be limited not by this detailed description but rather by the claims appended hereto.

What is claimed is:

1. An apparatus for monitoring a warewashing machine, comprising:

(a) sensor means for detecting alarm conditions in the warewashing machine;

(b) input means connected to the sensor means for receiving signals therefrom indicating the alarm condition;

(c) activation means connected to the input means for notifying an operator when the alarm condition has occurred;

(d) recording means connected to the input means for storing an indication of the alarm condition in a memory for later reporting;

(e) reset means for temporarily disabling the activation means for notifying the operator of the alarm condition; and (f) timer means for specifying a time period for the temporarily disabled alarm so that when the time period elapses the operator is once again notified by the activation means that the alarm condition has occurred.

2. The apparatus of claim 1, wherein the recording means further comprises means for timestamping and recording an operational history of the machine for an extended period of time.

3. The apparatus of claim 2, further comprising reporting means connected to the input means for generating an alarm detail report that allows an operator to determine the number of times alarm conditions occurred.

4. An apparatus for monitoring a warewashing machine, comprising:

(a) sensor means for detecting an active rinse cycle in the warewashing machine;

(b) input means connected to the sensor means for receiving signals therefrom indicating the active rinse cycle;

(c) recording means connected to the input means for recording an elapsed time period for the active rinse cycle;

(d) calculating means connected to the recording means for calculating a water consumption value using the elapsed time period and a known flow rate; and (e) reporting means connected to the calculating means for reporting the water consumption value.

5. An apparatus for monitoring a warewashing machine, comprising:

(a) first input means for receiving data from an operator indicating a total value of a customer's production;

(b) first recording means connected to the first input means for recording a total value of a customer's production;

(c) sensor means for detecting an active warewashing machine;

(d) second input means connected to the sensor means for receiving signals therefrom indicating the active warewashing machine;

(e) second recording means connected to the second input means for recording an elapsed time period for the active warewashing machine;

(f) calculating means connected to the second recording means for calculating a total value of operating hours using the elapsed time period; and (g) reporting means connected to the first and second recording means for reporting a comparison between the total value of a customer's production and the total value of the machine's operating hours.

6. An apparatus for monitoring a warewashing machine, comprising:

(a) sensor means for detecting operational information in the warewashing machine;

(b) data entry means for inputting production information;

(c) recording means, connected to the sensor means and the data entry means, for storing indications of the operational information and the production information in a memory for later reporting; and (d) reporting means, connected to the recording means, for comparing the production values with the operational information and printing efficiency information determined therefrom.

7. The apparatus of claim 6, wherein the operational information comprises a total number of operating hours for the machine.

8. The apparatus of claim 6, wherein the operational information comprises a total number of conveyer operating hours for the machine.

9. The apparatus of claim 8, wherein the operational information comprises a total number of rinse operating hours for the machine.

10. The apparatus of claim 6, wherein the production information comprises a total number of meals produced.

11. The apparatus of claim 6, wherein the production information comprises a total number of man hours of labor incurred by the machine.

12. The apparatus of claim 6, wherein the reporting means further comprises means for comparing a total number of rinse hours to a total number of operating hours, and thereby reporting a loading efficiency for the machine.

13. The apparatus of claim 6, wherein the reporting means further comprises means for comparing a total number of conveyer operating hours to a total number of operating hours, and reporting a conveyer efficiency for the machine.

14. The apparatus of claim 6, wherein the reporting means further comprises means for comparing a total number of meals processed to a total number of operating hours, and reporting an operating efficiency for the machine.

15. The apparatus of claim 6, wherein the reporting means further comprises means for dividing a total number of meals processed to a total number of rinse operating hours, and reporting a processing efficiency for the machine.

* * * * *